United States Patent [19]

Fritz

[11] 4,258,657

[45] Mar. 31, 1981

[54] PAINT STRIPER

[75] Inventor: DeWayne A. Fritz, Kewaskum, Wis.

[73] Assignee: Regal Ware, Inc., Kewaskum, Wis.

[21] Appl. No.: 16,844

[22] Filed: Mar. 2, 1979

[51] Int. Cl.[3] ..... B05C 1/08; B05C 1/16

[52] U.S. Cl. ..... 118/710; 118/219; 118/221; 401/220

[58] Field of Search ..... 118/710, 211, 711, 225, 118/219, 221, 222; 401/219, 220, 208; 33/36, 37, 41 C, 41 D; 101/328

[56] References Cited

U.S. PATENT DOCUMENTS

| | | | |
|---|---|---|---|
| 2,314,474 | 3/1943 | Bauman | 118/219 |
| 3,702,739 | 11/1972 | Rentfrow | 401/220 X |
| 3,874,330 | 4/1975 | Zoccolini | 118/221 X |

*Primary Examiner*—John P. McIntosh

*Attorney, Agent, or Firm*—Wheeler, Morsell, House & Fuller

[57] ABSTRACT

A striper (10) has a spring-loaded striping head (30) which connects with a reservoir (16) only when the head (10) is depressed by contact with a workpiece, and which does not feed paint or other striping material at any other time. A long, closely fitted tube (31) minimizes leakage and has a side opening (32) to valve stripe material. The parts are readily disassembled but are firmly held when assembled, for ready cleaning and replacement of worn parts. The reservoir (16) is preferably separate for each head (30), and separately fed for any striper head (30) or group of striper heads (30) to produce the desired pattern of stripes. The striper heads 30 may be of interchangeable widths. A stop 13 is the only part retaining all heads.

6 Claims, 4 Drawing Figures

PAINT STRIPER

Many striping devices, both manual and mechanical, are known. These include at least the following patents:

| Patent No. | Inventor | Dated |
|---|---|---|
| 207,160 | Brown | Aug. 20, 1878 |
| 342,484 | Wade | May 25, 1886 |
| 396,860 | Coston | Jan. 29, 1889 |
| 659,109 | Smith | Oct. 2, 1900 |
| 691,184 | Schickler | Jan. 14, 1902 |
| 798,250 | Ballance | Aug. 29, 1905 |
| 1,599,669 | Mitchell | Sep. 14, 1926 |
| 1,614,044 | Rohrich | Jan. 11, 1927 |
| 1,727,110 | Lecroy | Sep. 3, 1929 |
| 1,881,597 | Hoyos | Oct. 11, 1932 |
| 1,891,527 | Eklov | Dec. 20, 1932 |
| 1,904,558 | Starch | Apr. 18, 1933 |
| 1,934,552 | Moore | Nov. 7, 1933 |
| 1,947,714 | Harmon | Feb. 20, 1934 |
| 1,962,754 | Wallace | June 12, 1934 |
| 2,250,692 | Wise | July 29, 1941 |
| 2,333,451 | Sussman et al | Nov. 2, 1943 |
| 2,444,212 | Weakland | June 29, 1948 |
| 2,572,034 | Johnson | Oct. 23, 1951 |
| 2,610,580 | Burke | Sep. 16, 1952 |
| 2,644,975 | Verba | July 14, 1953 |
| 2,721,347 | Benkowski | Oct. 25, 1955 |
| 2,732,575 | Faust | Jan. 31, 1956 |
| 2,762,072 | Madalinski | Sep. 11, 1956 |
| 2,768,609 | Heynau | Oct. 30, 1956 |
| 2,823,633 | Meier et al | Feb. 18, 1958 |
| 2,995,083 | Wright | Aug. 8, 1961 |
| 3,003,468 | Rosenthal | Oct. 10, 1961 |
| 3,063,085 | Thomas | Nov. 13, 1962 |
| 3,064,607 | Gothe et al | Nov. 20, 1962 |
| 3,083,397 | Thomas | Apr. 2, 1963 |
| 3,095,598 | Gonnella et al | July 2, 1963 |
| 3,100,908 | Engle | Aug. 20, 1963 |
| 3,164,906 | Andaloro | Jan. 12, 1965 |
| 3,182,347 | Haines | May 11, 1965 |
| 3,183,887 | Derderian | May 18, 1965 |
| 3,359,590 | Perillo | Dec. 26, 1967 |
| 3,374,050 | Rabin et al | Mar. 19, 1968 |
| 3,541,930 | Goodrich | Nov. 24, 1970 |
| 3,658,432 | Lanusse | Apr. 25, 1972 |
| 3,854,631 | Moen | Dec. 17, 1974 |
| 3,917,419 | Kumakura et al | Nov. 4, 1975 |
| 2,533,704 | Zanetti | Dec. 12, 1950 |

However, the requirements for reliably and repeatedly striping large numbers of workpieces in an industrial process with low leakage, high confidence as to the quality of the striping, and with high ability to maintain the striping heads in clean and unworn condition for reliability are very strict.

Another important feature is the reservoir which is divided and which is fed from separate sources of paint under moderate pressure, which may be gravity or another pressure source, such as mechanical pressure, air pressure, or the like, but with a single reservoir cover. The spring biasing the head outward also strains the striping material. The head is mounted on a feed tube in a long closely fitted bore communicating with a close fitting pocket for the wheel at one end and a cross bore to valve striping material from the reservoir at the other for low leakage. The spring pushes the end of the tube and strains stripe material from the feed passage.

DRAWINGS

DETAILED DESCRIPTION

Figure 1:
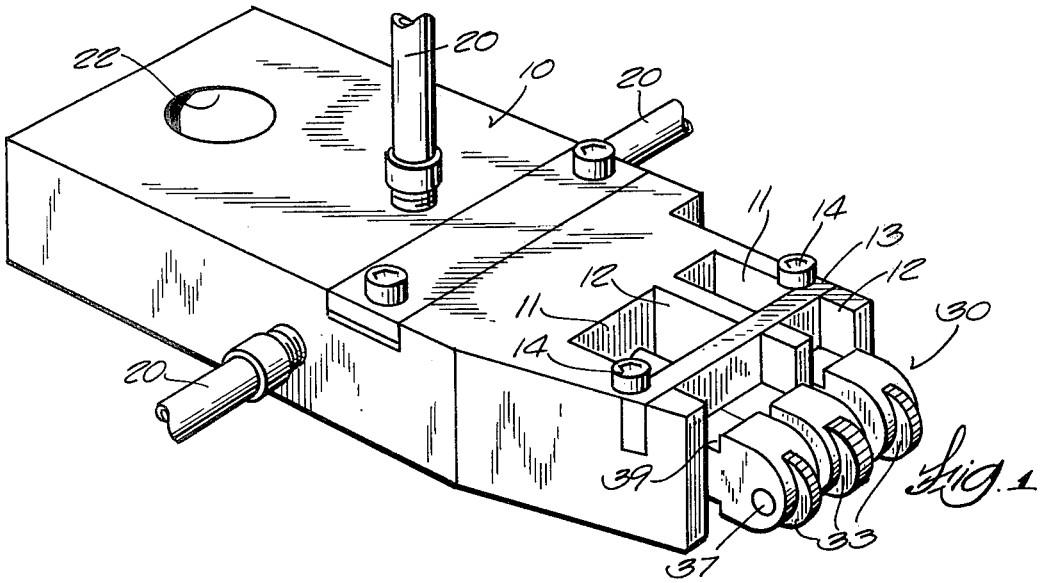
FIG. 1 is a perspective view of the striper of my invention.

Although the disclosure hereof is detailed and exact to enable those skilled in the art to practice the invention, the physical embodiments herein disclosed merely exemplify the invention which may be embodied in other specific structure. While the best known embodiment has been described, the details may be changed without departing from the invention, which is defined by the claims.

The paint striper shown in the drawings consists of a body 10 having a head end into which a sufficient number of channels 11 are cut to provide a channel wall 12 against which each striper head 20 may slide. Spanning all of the channels 11 is a single stop bar 13 held by the heads 14 of screws which overlap bar 13 and are inserted in threaded holes in body 10.

Figure 2:
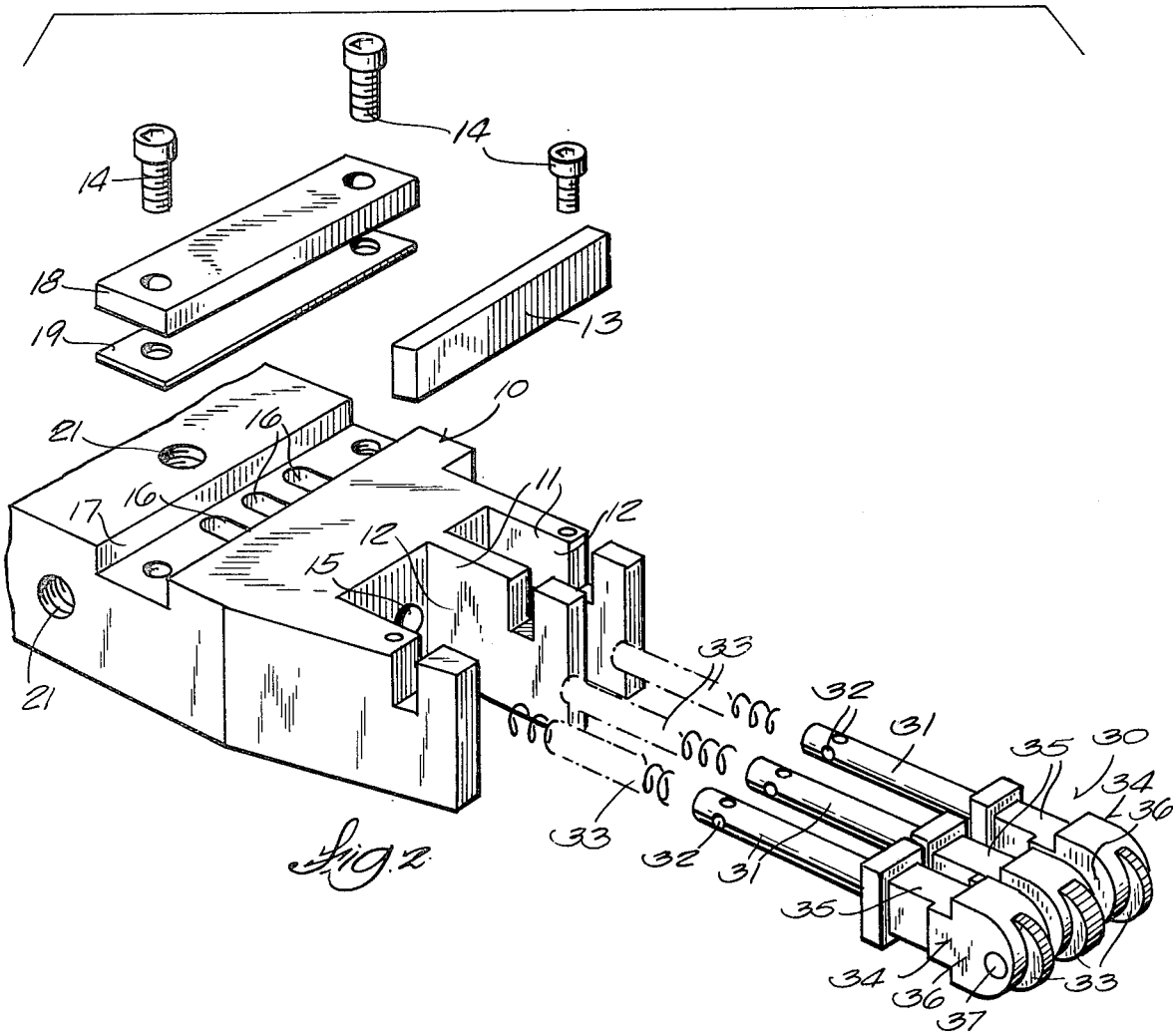
FIG. 2 is an exploded perspective view.
Figure 3:
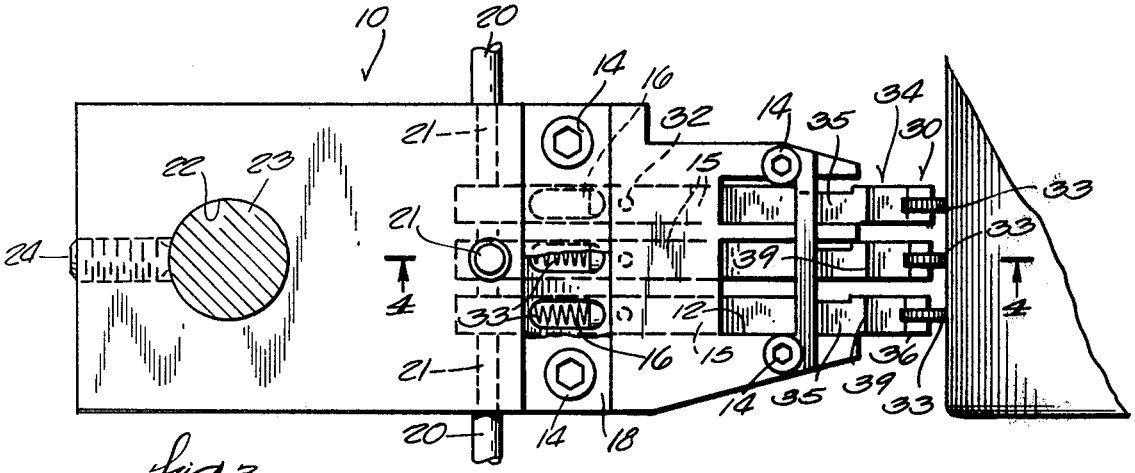
FIG. 3 is a broken away plan view.
Figure 4:
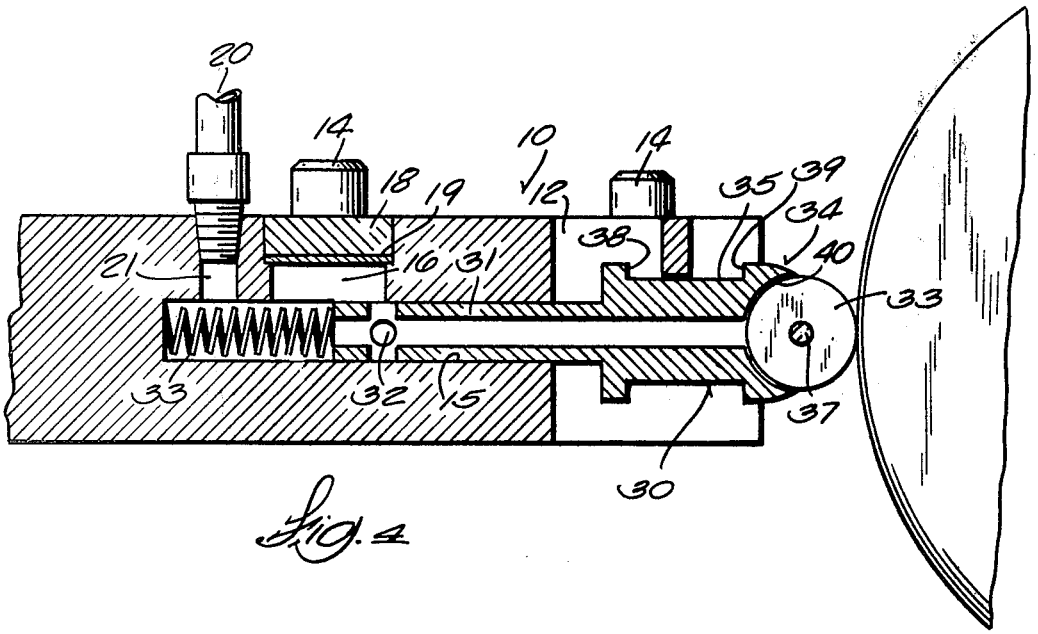
FIG. 4 is a cross sectional view on line 4—4 of FIG. 3.

As best shown in FIGS. 2, 3, and 4, the body 10 is formed with a series of parallel bores 15 to receive tubes attached to heads 30 which will be described later. Body 10 is also provided with a series of reservoirs 16 all of which open into a slot 17 into which a bar 18 and a gasket 19 fit to close the tops of all of the reservoirs 16, held by any conventional fastening means such as the screws shown.

The body 10 is provided with a number of paint conduits 20 to bring in striping material such as paint to be deposited by the striper heads. These extend from a conventional low pressure source of such material such as a paint bucket. For many applications, gravity feed at a head of a few feet is sufficient, although other low pressure feed means such as mechanical pressure and pneumatic pressure are known and acceptable, depending on the exact nature of the material to be applied by the striper and the availability of formulations suitable for the various feed means. The precise nature of the feed means is not a part of this invention.

Each conduit 20 is connected by a conventional means, here shown as a threaded connection to a bore 21 extending to the side of an extension of bore 15, through spring 33 which serves as a strainer that is easily cleaned to reservoir 16. (FIG. 3) If it is desired to feed pecisely the same material to more than one of the striper heads, the conduits 20 may be interconnected or may extend from the same source of stripe material.

The body 10 is desirably provided with a bore 22 to fit a mounting post 23 and held with a set screw 24 although other means may be adopted for suspending body 10 if desired.

A series of striper heads 30 is mounted in body 10 by means of tubes 31 each of which is provided with side holes 32 to valve and receive paint from reservoirs 16. All of the holes 32 are the same distance from the work piece contacting surface of rollers 33 and all of the ends of reservoirs 16 nearest the paint striping heads are the same distance from stop 13. A biasing means, shown as spring 33 pushes each paint striping head outwardly with respect to stop 13. The main portion of each paint striping head comprises a head block 34 provided with a laterally extending groove 35 to receive stop 13 and having at least one flat face 36 in face contact with a corresponding surface 12 of body 10.

While stop 13 is in place, the heads may move longitudinally with respect to the body 10 as tubes 31 slide in close fitting bores 15 against the bias of springs 33.

When holes 32 reach reservoirs 16, paint is supplied to the wheels 33 which are mounted in heads 34 in slots shaped to just receive the wheels, by means of pins 37. Desirably, wheels 33 are knurled to a proper quantity of the material to be striped. The tubes 15 and slots in the heads make a long leakage path to confine the strip material.

When cleaning or servicing is needed, it is necessary to release only two screws to release stop bar 13, whereupon all of the heads and springs may be removed. Two more screws expose all of the reservoirs 16. With the conduits 20 disconnected all of the parts associated with the striping head may be immersed in solvent and are extremely accessible for cleaning. Likewise, if there is wear of the striping wheels 33 they may be replaced readily by driving a single pin and placing a new wheel in place and replacing the pin. Likewise the arrangement described makes it extremely convenient to change the striping pattern since a given head 34 may have a striping wheel of any of a variety of widths in it, or it is possible to omit a striping wheel from the set-up altogether to change the striping pattern.

The leakage pathways are extremely long, both along the tubes 31 and bores 15, and at the sides of wheels 33. The parts are in substantially face contact over large areas and thus prevent leakage of the striping material to locations where it is not desired. Nevertheless, the desired passageways are extremely open and can carry paint material to be striped at low pressures further contributing to the freedom from leakage.

I claim:

1. In a stripe applying head a plurality of stripe applying wheels rotatably mounted in respective non-rotatable head members, respective biasing means applying outward pressure to each head and thereby to the periphery of the respective wheels, a single stop mounted to limit the response of all of said head members to said biasing means, a tube extending from each said head member to the corresponding biasing means, a body member surrounding the tubes and containing a separate reservoir touching each said tube, at lease one hole in each tube at a location to interconnect the tube with the respective reservoir only when the head member and tube are moved against said bias a predetermined distance and to be out of alignment with said reservoir when said head responds to said biasing means sufficiently to be stopped by said stop member, and separate respective means supplying striping material to each said reservoir under low pressure to be applied by the respective wheels.

2. The device of claim 1, all of said reservoirs being closed by a common gasket and a common cover member, and said supply means comprising separate supply tubes extending through said body to each said reservoir.

3. The device of claim 1, each said head member having a channel, and said stop member lying in the channel of each said head member to limit both inward and outward movement when said stop member is in place.

4. The device of claim 3 in which said stop member has a surface coplanar with the surface of the body and in which the body is provided with a threaded hole immediately adjacent the stop member and a fastener having a head overlying the stop member threaded into said holes.

5. The device of claim 1 in which the body is provided with a separate bore of substantial length closely fitting each said tube extending from the reservoir toward the head, said tubes each communicating with a slot in the head fitting the periphery and said of said wheel closely, said wheel being grooved at the periphery to carry stripe material, whereby to limit the leakage of strip material.

6. The device of claim 1 in which the biasing means is a coil spring coaxial with the tube and occupying a hole in the body which is part of the means supplying striping material to the reservoir, said means further including a passage extending into the hole from the side so striping material is fed through the spring.

* * * * *